US005857596A

United States Patent [19]

Lee

[11] Patent Number: 5,857,596

[45] Date of Patent: Jan. 12, 1999

[54] WATER DISPENSER OF A REFRIGERATOR

[75] Inventor: Yong-Kweon Lee, Incheon, Rep. of Korea

[73] Assignee: Daewoo Electronics Co., Ltd., Rep. of Korea

[21] Appl. No.: 796,112

[22] Filed: Feb. 6, 1997

[30] Foreign Application Priority Data

Jun. 29, 1996 [KR] Rep. of Korea ..... 96-26145

[51] Int. Cl.[6] ..... B65B 3/04

[52] U.S. Cl. ..... 222/509; 222/146.6; 222/505; 222/183; 62/338

[58] Field of Search ..... 222/146.6, 183, 222/505, 509, 518; 251/236, 243, 339, 229, 263; 62/338

[56] References Cited

U.S. PATENT DOCUMENTS

| | | | |
|---|---|---|---|
| 999,602 | 8/1911 | Slee | 222/509 |
| 2,239,921 | 4/1941 | Majewski, Jr. | 222/183 |
| 2,274,409 | 2/1942 | Harbison | 222/183 |
| 2,512,395 | 6/1950 | Sundberg | 222/509 |
| 2,761,288 | 9/1956 | Anderson et al. | 62/338 |
| 2,775,877 | 1/1957 | Bruntjen | 222/146.6 |
| 2,777,304 | 1/1957 | Nave | 222/146.6 |
| 2,781,153 | 12/1957 | Roberts | 222/183 |
| 3,107,828 | 10/1963 | Costakos | 222/509 |
| 3,208,641 | 9/1965 | Brugioni | 62/338 |
| 5,142,610 | 8/1992 | Augustine et al. | 222/509 |
| 5,303,849 | 4/1994 | Crele . | |
| 5,526,854 | 6/1996 | Unger | 222/146.6 |

*Primary Examiner*—J. Casimer Jacyna
*Attorney, Agent, or Firm*—Pillsbury Madison & Sutro, LLP

[57] ABSTRACT

A water dispenser of a refrigerator which includes a reservoir for storing water, and which is positioned in a pocket, a holding member for supporting the pocket, a valve assembly for supporting the holding member, and an opening section for operating the valve assembly. The holding member is inserted into the holding member upside down. The valve assembly includes an outlet conduit screw-coupled to the reservoir, through which the water contained in the reservoir is exhausted. The outlet conduit is opened and closed by a packing member, and the packing member is moved upward and downward by the valve rod. The valve rod is moved upward by a lever of the opening section. The lever has a dispensing head which is provided on an upper surface thereof with a pair of opening protrusions. Also, a stopper obstructs the lever so that the lever cannot pivot. The water dispenser is simple in structure, increases efficient space use of the refrigerating compartment door, is convenient to use, and can be cleanly maintained.

13 Claims, 7 Drawing Sheets

WATER DISPENSER OF A REFRIGERATOR

BACKGROUND OF THE INVENTION

1. Field of the Invention

The present invention relates to a water dispenser of a refrigerator, and more particularly to a valve assembly of a water dispenser.

2. Description of the Prior Art

A water dispenser or beverage dispenser is an implement for automatically dispensing drinking water or beverages, which is installed in a house, an office, or a public lot for domestic or commercial use. Valve assemblies of beverage dispensers which are available for commercial business, usually employ actuators, and one of such actuators is disclosed in U.S. Pat. No. 5,303,849 issued to Credle, Jr. on Apr. 19, 1994.

A water dispenser is also utilized in a house or an office. Recently, various kinds of beverage dispensers have been suggested to be installed to refrigerators. A refrigerator is an appliance for storing a variety of foodstuffs in freezing and/or refrigerating temperatures in order to maintain freshness of the foodstuffs for a long period of time. The refrigerator is generally provided with compartments for storing foodstuffs, i.e., freezer and refrigerating compartments for storing foodstuffs in freezing and refrigerating temperatures respectively. The freezer and refrigerating compartments are supplied with cooling air, which are cooled by an evaporator of the refrigerator.

The cooling air is directly supplied by a fan to the interior of the freezer compartment from the evaporator. Some of the cooling air is supplied to the interior of the refrigerating compartment, and some to the interior of the refrigerating compartment. The temperature of the cooling air is a little raised so as to be a refrigerating one, as it flows through a duct internally formed to the refrigerator to be supplied to the refrigerating compartment. The freezer and refrigerating compartments are respectively installed with doors at their front sides to allow foodstuffs to be put in and taken out.

In addition, an amount of drinking water is stored in the interior of the refrigerating compartment. The water is filled up in a reservoir provided in the refrigerating compartment. In order for a user to drink the water stored within the refrigerating compartment, the door should be opened to take out the container filled with the drinking water. However, the refrigerating efficiency of the refrigerator is lowered by frequently openings of the door of the refrigerating compartment.

Recently, in order to overcome the above-mentioned efficiency problem, water dispensers have been suggested, in which drinking water can be taken out from refrigerating compartments, even without opening the door of the refrigerating compartments. FIG. 1 shows a conventional water dispenser 100 of a refrigerator disclosed in Korean Utility Model Laid-Open No. 92-4897. As shown in FIG. 1 the valve assembly 110 installed inside of a door 10 includes a valve body 120 having an inlet 122 connected to a reservoir (not shown) installed to the inner side of the compartment door 10 and an outlet 124 penetrating through the lower surface thereof, a valve spool 130 for opening and closing the outlet 124, a valve cap 140 for closing an upper portion of the valve body 120, and a lever 150 for moving the valve spool 130 upward and downward by pivoting motions thereof.

The valve spool 130 includes the valve rod 134 which is connected to the lever 150 by a hinge 132 so as to move upward and downward by the pivoting motions of the lever 150, a packing member 136 which is attached to the lower end of the rod 134 to close the outlet 124 of the valve body 120 when the lever 150 is released, and a spring 138 which is installed between the lower surface of the valve cap 140 and the packing member 136 to exert a biasing force upon the rod 134. The inlet 122 of the valve body 120 communicates with the inner side of the door 10, and is connected to the reservoir attached to the inner side of the door 10. The water contained in the reservoir is introduced into the interior of the valve body 120 through the inlet 122, and the inlet 122 is always filled with the water.

When a user grips a cup 20 and pushes the lever 150 by the cup 20 in order to drink the water contained in the reservoir, the lever 150 is pivoted to move the rod 134 upward by overcoming the biasing force of the spring 138, thereby opening the outlet 124. Then, the water contained in the reservoir flows through the outlet 114 and fills the cup 20 positioned below the outlet 114.

For sanitary reasons, a disposable cup such as a paper cup or a paper-envelope cup is generally used as a cup for the water dispenser. However, since the paper cup 20 is made of a soft material, it is apt to be deformed when the lever 150 is pushed by means of the paper cup 20. Therefore, the user usually push the lever 150 by the hand which grips the paper cup 20. In that case, however, it has a disadvantage that the hand is also apt to be wet with the water dropping from the outlet 124 of the valve assembly 110. Further, the large space occupied by the valve assembly 110 to be connected to the reservoir of the refrigerating compartment impair the space efficiency of the refrigerating compartment. In addition, deposits which make filthy the water contained in the reservoir can be formed in the inner surface of the inlet 122 of the valve body 120 over time.

A water dispenser which is directed to overcome the above-mentioned disadvantages is disclosed in Korean Utility Model Laid Open No. 95-33940. As shown in FIG. 2, the water dispenser 200 includes a reservoir 210 for storing water, a dispensing panel 220 in which the reservoir 210 is positioned upside down, a dispensing port 230, a lever 250 for operating the dispensing port 230.

A spout 212 for filling water thereinto is formed in the reservoir 210 and is engaged with a cap 214. A valve 216 is mounted in the cap 214 such that, when the valve 216 is opened, the water contained in the reservoir 210 is exhausted through the spout 212. The spout 212 of the reservoir 210 is inserted into the connecting hole 222 of the dispensing panel 220. The interior of the connecting hole 222 is maintained filled with the water.

Fixed to the lower end of the connecting hole 222 is a fixing plate 232 in which a plurality of first dispensing holes 234 is formed, and positioned below the fixing plate 232 is an moving plate 236 in which a plurality of second dispensing holes 238 is formed. The first dispensing holes 234 communicate with the second dispensing holes 238 by the movement of the moving plate 236, and the water contained in the reservoir 210 is exhausted outside the reservoir 210.

A biasing spring 240 is installed at one side of the moving plate 236, and exerts a biasing force on the moving plate 236. The moving plate 236 is moved by the biasing force so that the first and second dispensing holes 234 and 238 are closed to stop the outflow of the water. The moving plate 236 is moved by a lever 250 installed at one side thereof. The lever 250 is pivotally mounted to the inner side of the dispensing panel 220 by means of a hinge 252. By the pivotal movement of the lever 250, the moving plate 236 is moved so as to connect the first and second holes 234 and 238, overcoming the biasing force of the biasing spring 240. Provided at the inner side of the moving plate 236 is a dispensing port 230 which provides a water flowing path in the interior of the reservoir 210.

When the lever 250 is pushed by a cup or with a hand, the lever 250 is pivoted. Then, the moving plate 236 is moved, overcoming the biasing force of the biasing spring 240. As a result, the first and second holes 234 and 238 come to communicate with each other so that the water contained in the reservoir 210 drops.

However, in the water dispenser 200, the fixing plate 232 and the moving plate 236 are needed to be sealed, when the first and second holes 234 and 238 are closed. In case the fixing plate 232 and the moving plate 236 are not sealed, the water contained in the reservoir 210 is leaked between the fixing plate 232 and the moving plate 236. Therefore, a considerable amount of friction forces are generated between the fixing plate 232 and the moving plate 236, and a large force is needed to pivot the lever 250. Further, the dispenser 200 is apt to be filthy due to the deposits formed in the connecting holes 222.

SUMMARY OF THE INVENTION

Therefore, it is an object of the present invention to provide a water dispenser of a refrigerator capable of facilitating the use thereof and increasing the efficient use of a door.

To achieve the above object of the present invention, a water dispenser of a refrigerator according to the present invention comprises:

a reservoir installed in a pocket of the inner side of the refrigerator door, for storing water therein;

a holding member for supporting the pocket;

a dispensing panel having a support conduit in which a latching boss is formed on an inner peripheral surface thereof, a support plate connected to a lower portion of the support conduit, and a rear plate which has a bracket and supports the support plate, the rear plate being connected to the lower portion of the support plate;

a valve assembly inserted into and mounted to the holding member, the valve assembly having a connecting section connected to the reservoir, a valve cock selectively closing and opening the connecting section at first and second positions respectively, and a bias spring for exerting a first biasing force on the valve cock so that the valve cock is positioned at the first position; and an opening means for opening the valve assembly, the opening means including a subpanel mounted in the dispensing panel, a lever pivotally mounted in the subpanel, for moving the valve cock so that the valve cock is positioned at the second position, a button provided with a connecting protrusion which is inserted into the slit, for pivoting the lever, and a return spring placed between a lower surface of the supporting plate and an upper surface of the lever, for exerting a second biasing force to the lever.

According to the present invention, the connecting section includes a cap screw-coupled to the reservoir; an outlet conduit formed along the length of the cap and penetrating the centerline of the cap; a guide member formed at an inner side of the outlet conduit; and a guide conduit formed on the bottom surface of the cap along the length of the cap.

The valve cock further includes a first cylinder, in which an inner peripheral surface thereof slides on an outer peripheral surface of the outlet conduit; a second cylinder, in which an outer peripheral surface thereof slides on an inner peripheral surface of the outlet conduit; a shoulder connecting one end of the first cylinder to one end of the second cylinder; a packing member for closing the outlet conduit at the first position and opening the outlet conduit at the second position; a valve rod for moving the packing member to the first or second position; and a fixing rib, to which a lower end of the valve rod is fixed.

The opening section includes a subpanel including a base plate, a pair of side walls which are connected to both sides of the base plate, and on which hinge grooves are formed, a mounting guide which connects respective rear ends of the side walls to each other, a second mounting plate for mounting the subpanel to the support plate, and a guide rail located in front of the second mounting plate; a lever pivotally mounted to the subpanel, the lever having a dispensing head connected to an end thereof for moving the valve cock to the second position, hinges inserted into the hinge grooves of the side walls, and a slit formed at an end of the lever; a return spring for exerting a second biasing force to the lever; and a button for pivoting the lever, the button being provided with a connecting protrusion which is inserted into the slit.

When a user pushes the button down, the lever pivots and overcomes the second biasing force of the return spring. The valve cock rises to the second position while overcoming the second biasing force of the return spring by pivoting of the lever. At this time, the packing member opens the outlet conduit. Thus, the water in the reservoir falls into a cup via the outlet conduit, the dispensing hole and the longitudinal hole.

If the button is released, the valve cock is lowered by the first biasing force of the bias spring. By the lowering of the valve cock, the lever returns to an original position by the second biasing force of the return spring. Thus, the packing member is lowered down to the first position and the outlet conduit is closed by the packing member.

The water dispenser of a refrigerator according to the present invention is simple in structure, increases efficient space use of the refrigerating compartment door, is convenient to use, and can be cleanly maintained.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

A preferred embodiment of a valve assembly of a water dispenser for a refrigerator according to the present invention will be described in detail with reference to the accompanying drawings.

Figure 1:
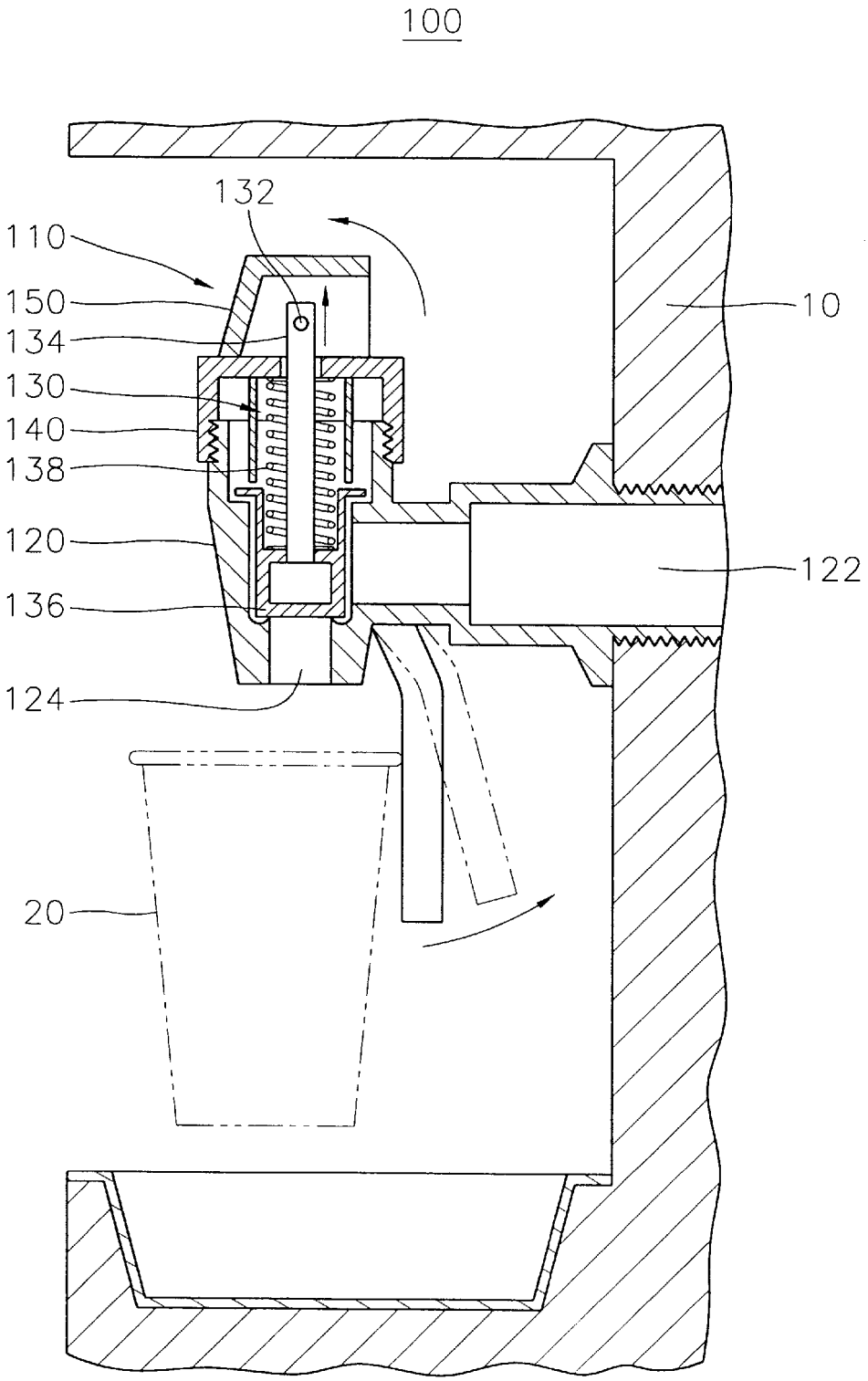
FIG. 1 (PRIOR ART)
FIG. 1 is a sectional view showing a conventional water dispenser of a refrigerator.
Figure 2:
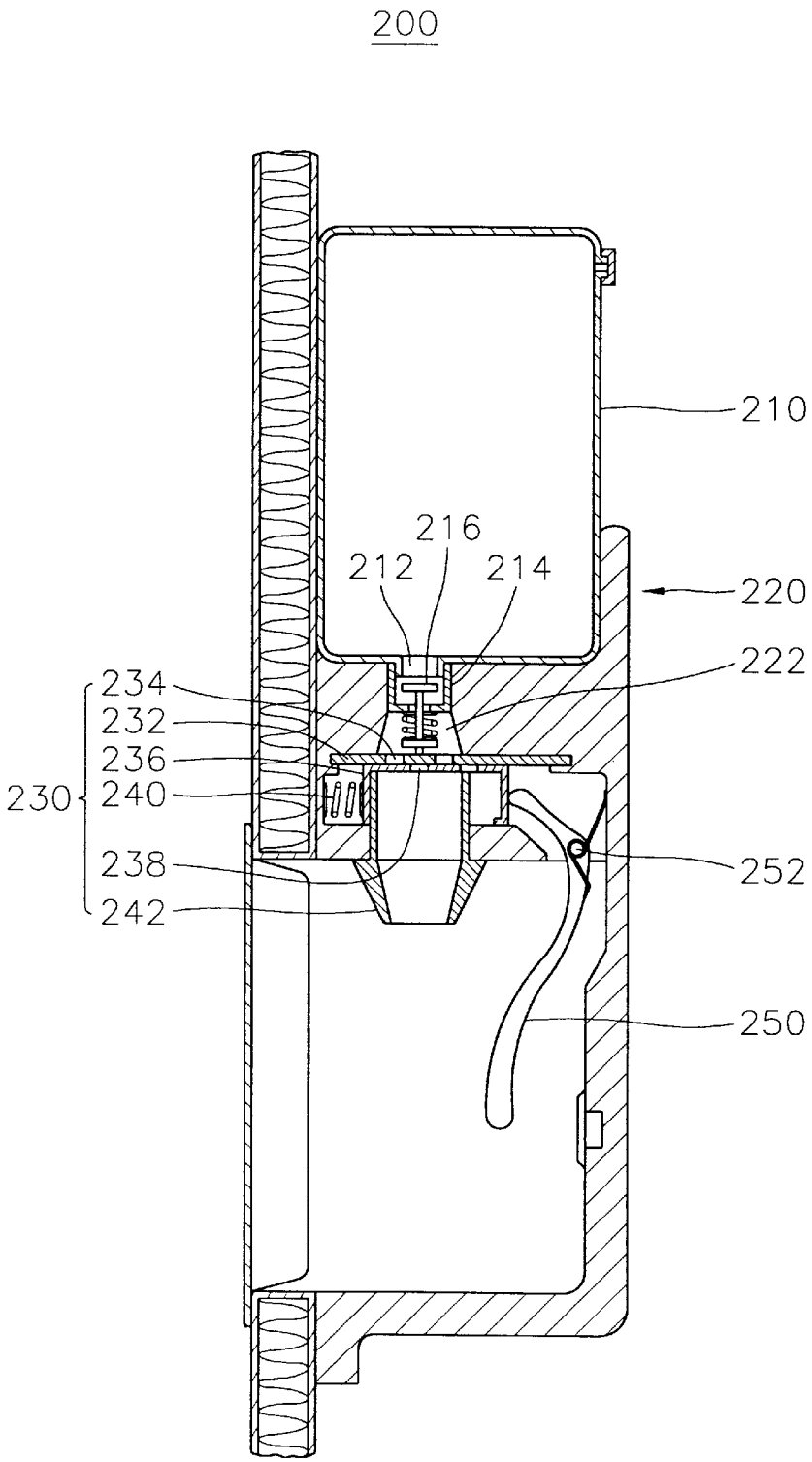
FIG. 2 (PRIOR ART)
FIG. 2 is a sectional view showing another conventional water dispenser of a refrigerator.
Figure 3:
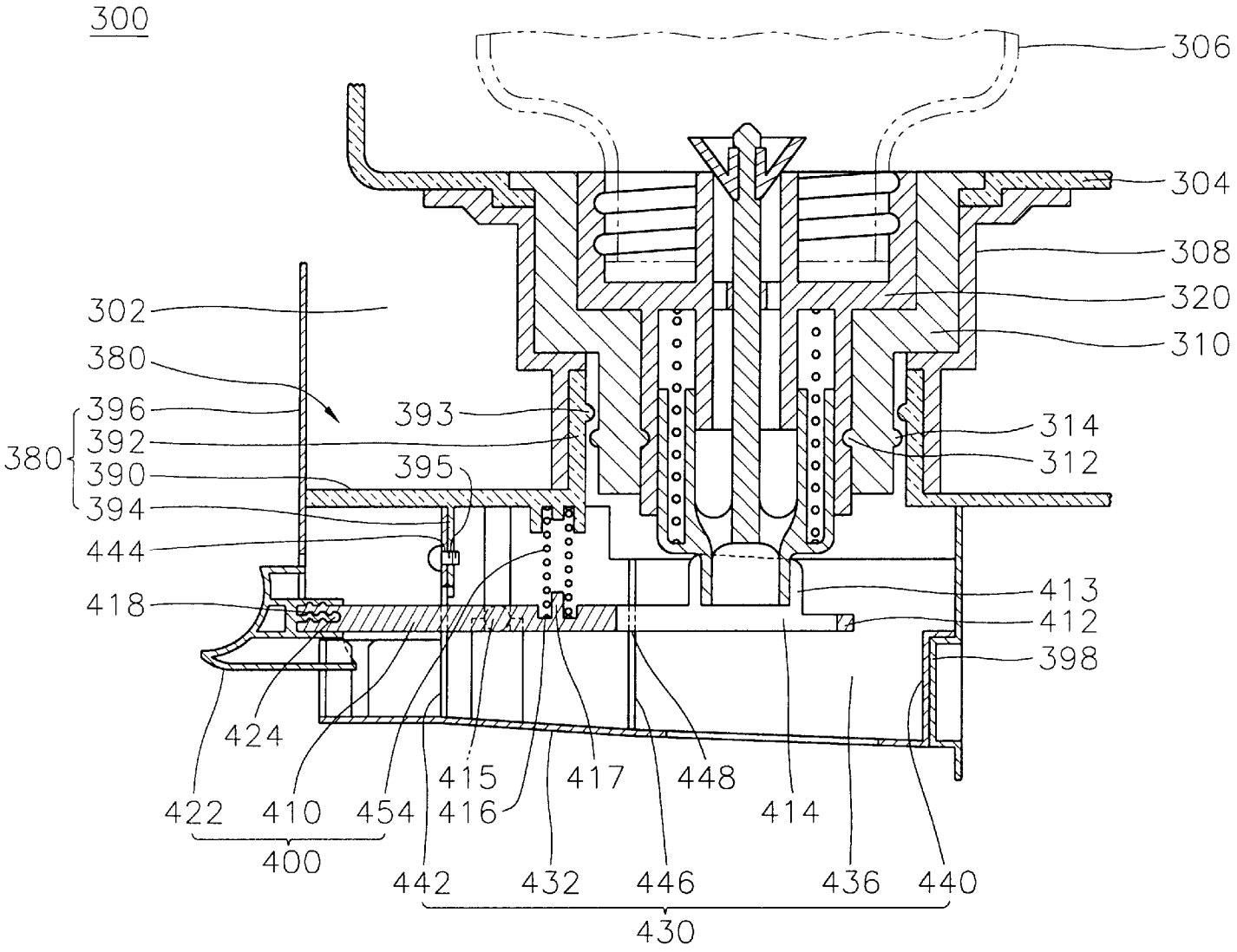
FIG. 3 is a sectional view showing a water dispenser of a refrigerator according to the present invention.

FIG. 3 shows a water dispenser 300 of a refrigerator according to an embodiment of the present invention. As shown in FIG. 3, the water dispenser 300 includes a reservoir 306 for storing water, which is located in a pocket 304 inside a refrigerator door 302, a holding member 308 which supports the pocket 304, a dispensing panel 380 which supports the holding member 308, a valve assembly 320 which opens and closes the reservoir 306, and is engaged with the reservoir 306, and an opening section 400 which operates the valve assembly 320. The reservoir 306 stores water and is inserted into and mounted to the holding member 308 upside down after it is assembled together with the valve assembly 320.

The holding member 308, as shown in FIG. 3, has a bell-shaped cross section, and has upper and lower inner surfaces. A mounting member 310 is inserted into the holding member 308. The mounting member 310 has also a bell-shaped cross-section, and first and second mounting bosses 312 are respectively formed on the inner and outer peripheral surfaces thereof. The valve assembly 320 is inserted into the mounting member 310.

Figure 4:
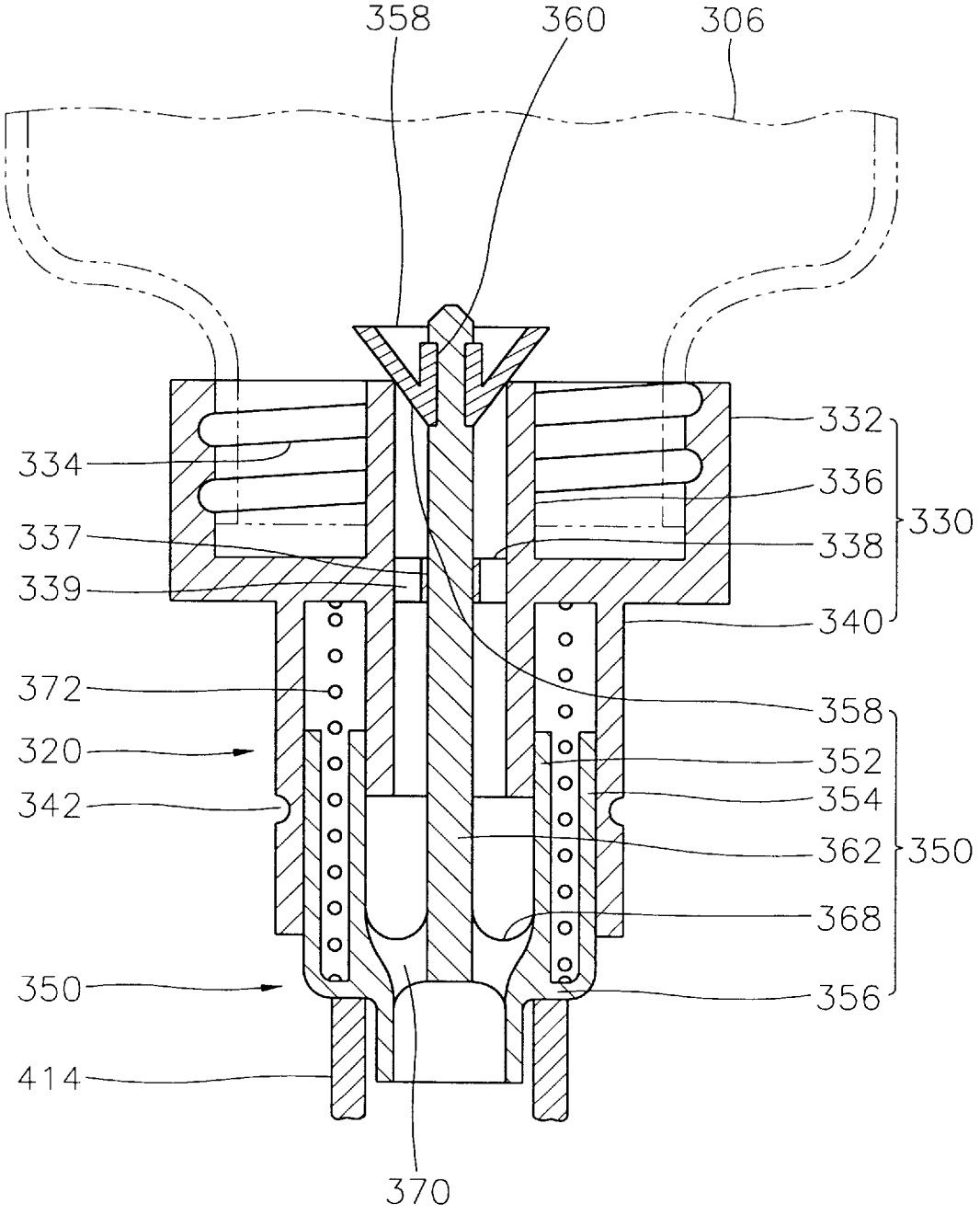
FIG. 4 is an enlarged sectional view showing a valve assembly of the water dispenser shown in FIG. 3.

As shown in FIG. 4, the valve assembly 320 includes a connecting portion 330 which is connected to the reservoir 306, a valve cock 350 which closes and opens the connecting portion 330 at first and second positions respectively, and a bias spring 372 which exerts a first biasing force on the valve cock 350 so that the valve cock 350 is positioned at the first position.

The connecting portion 330 includes a cap 332 threaded in the reservoir 306, an outlet conduit 336 which is formed penetrating the center of the cap 332 and along the length of the cap 332, and through which the water contained in the reservoir 306 is flowed, a guide conduit 340 which is formed on the bottom surface of the cap 332 along the cap 332 and forms a circle concentric to an outlet conduit 336 and having a diameter larger than that of the outlet conduit 336, and a guide conduit 340 having a mounting groove 342 which is formed on the outer peripheral surface thereof, and into which the first mounting boss 312 of the mounting member 310 is inserted.

At the inner peripheral surface of the cap 332 is formed a screw 334 which engages with the reservoir 306. At the inner side of the outlet conduit 336 is formed a guide member 338. A guide hole 337 is formed at the center of the guide member 338, and a plurality of first exhausting holes 339 are formed adjacent to the guide hole 337. The water from the reservoir 306 flows to the lower portion of the outlet conduit 336 through the first exhausting holes 339. Integrally formed are the cap 332, the outlet conduit 336, the guide conduit 340, and the guide member 338.

The valve cock 350 includes a first cylinder 352, in which the inner surface thereof slides over the outer surface of the outlet conduit 336, a second cylinder 354, in which the outer surface thereof slides into the inner surface of the guide conduit 340, a shoulder 356 which connects the first cylinder 352 to the second cylinder 354, a packing member 358 which closes the outlet conduit 336 at the first position and opens the outlet conduit 336 at the second position, a valve rod 362, in which the packing member 358 is inserted into, to an upper end thereof the packing member 358 is fixed, and which is inserted into the guide hole 337 and moves the packing member 358 from the first position to the second position, and a fixing rib 368 which is formed in the interior of the first cylinder 352 so as to fix the valve rod 362, and in which a second exhausting hole 370 is formed.

The packing member 358 has a conical shape and is made of silicon, a rubber, or the like. An engaging hole 360 is formed at the center of the packing member 358. The valve rod 362 is engaged with the packing member 358 by inserting the upper end of the valve rod 362 into the engaging hole 360 of the packing member 358. The packing member 358 is moved by the valve rod 362 to the first or second position and closes or opens the outlet conduit 336.

Integrally formed are the first cylinder 358, the second cylinder 354, the valve rod 362, the shoulder 356, and the fixing rib 368. The bias spring 372 is mounted in surrounding relationship to the outlet conduit 336 and applies the first biasing force to the valve cock 350. Thus, the valve cock 350 is placed at the first position by the first biasing force of the bias spring 372.

Figure 7:
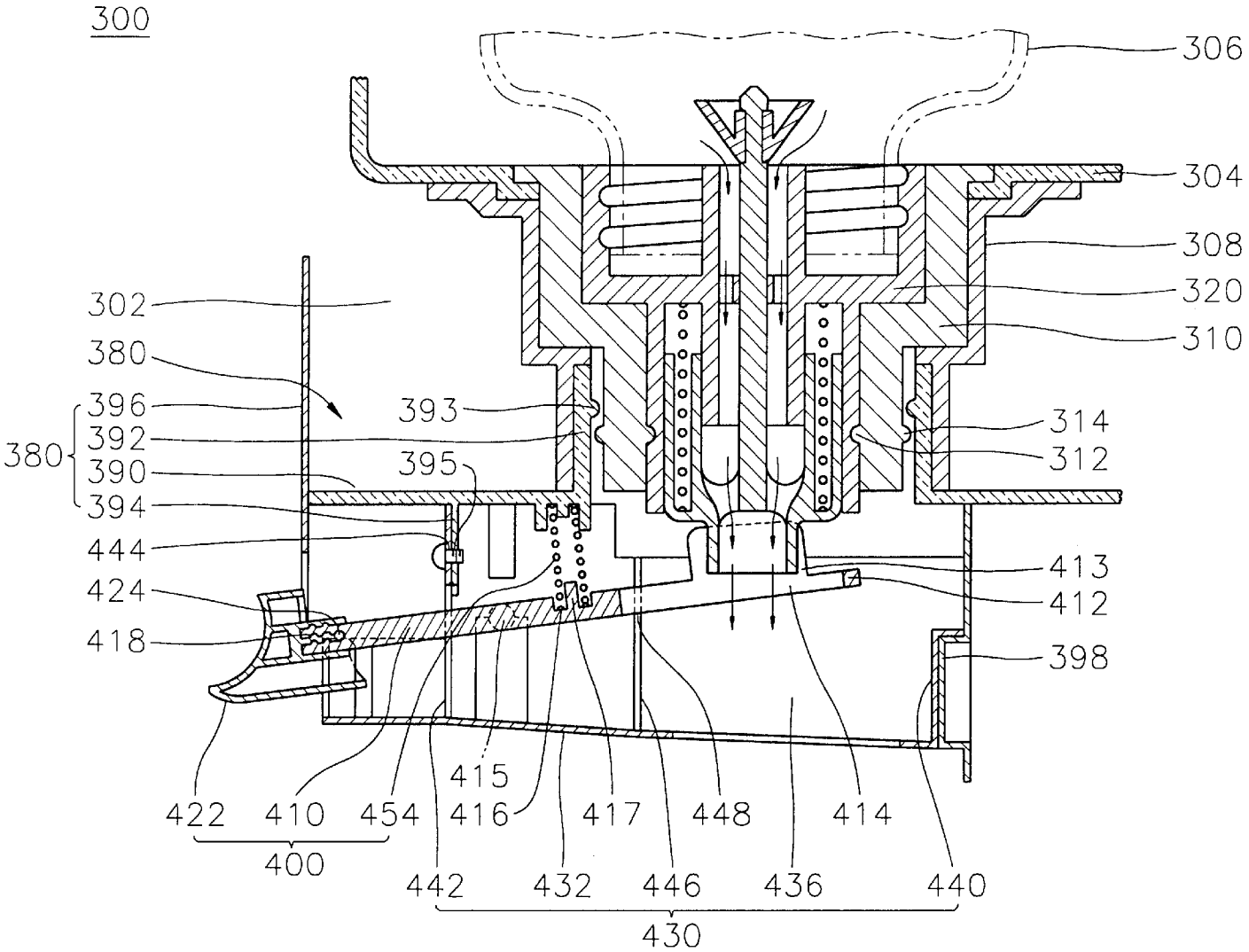
FIG. 7 is a sectional view showing the open state of the water dispenser shown in FIG. 3.

The holding member 308, as shown FIGS. 3 and 7, is supported by the dispensing panel 380. The dispensing panel 380 includes a support plate 390 supporting the holding member 308 and a rear plate 396 which is connected to the support plate 390 and supports the support plate 390.

The support plate 390 includes a support conduit 392, which is inserted into the inner peripheral surface of the holding member 308 and supports the holding member 308, and a first mounting plate 394, on which the opening section 400 is mounted. The first mounting plate 394 is formed by extending from a lower surface of the support plate 390, and is formed with a pair of screw hole 395.

On the inner surface of the support conduit 392 is formed a latching boss 393 which cooperates with the second mounting boss 314. When the mounting member 310 is inserted into the interior of the holding member 308, the second mounting boss 314 makes contact with the latching boss 393. The support conduit 392 and the mounting member 310 are then deformed in the radial direction by the latching boss 393 and the second mounting boss 314. Once the second mounting boss 314 passes over the latching boss 393, the mounting member 310 does not deviate from the support conduit 392 since the latching boss 393 blocks the second mounting boss 314.

The support plate 390 is supported by the rear plate 396. The rear plate 396 is connected to the lower surface of the support plate 390 and is formed with a bracket 398 on its surface. The rear plate 396 provides a dispensing space, at which a cup is supplied with the water from the reservoir 306.

After the mounting member 310 is inserted into the holding member 308, and the valve assembly 320 is inserted into the mounting member 310. The valve assembly 320 is inserted into and fixed to the mounting member 310 in the same manner that the first mounting boss 312 is inserted into the mounting groove 342 of the guide conduit 384.

Figure 5:
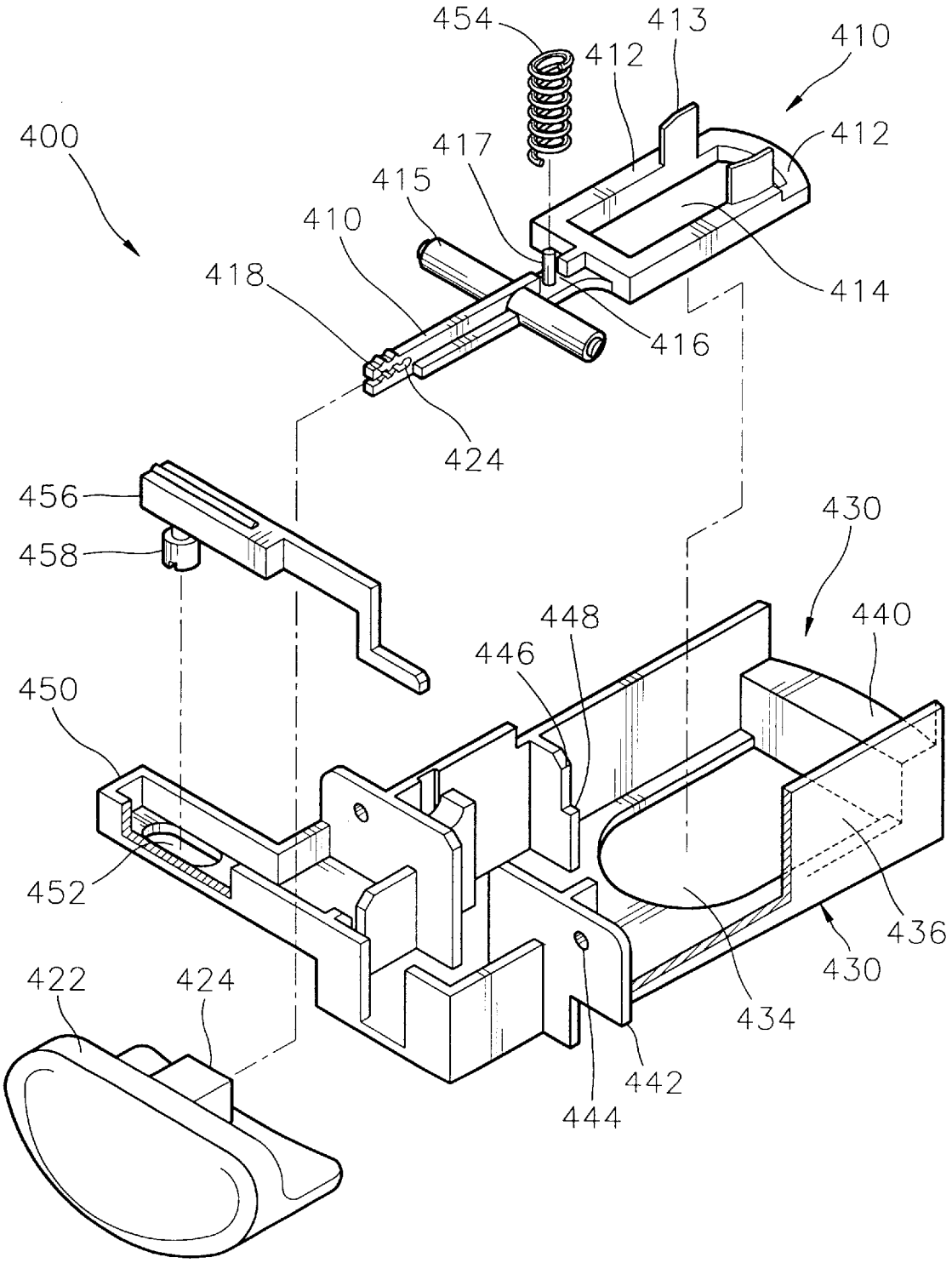
FIG. 5 is an exploded perspective view showing an opening section of the water dispenser shown in FIG. 3.
Figure 6:
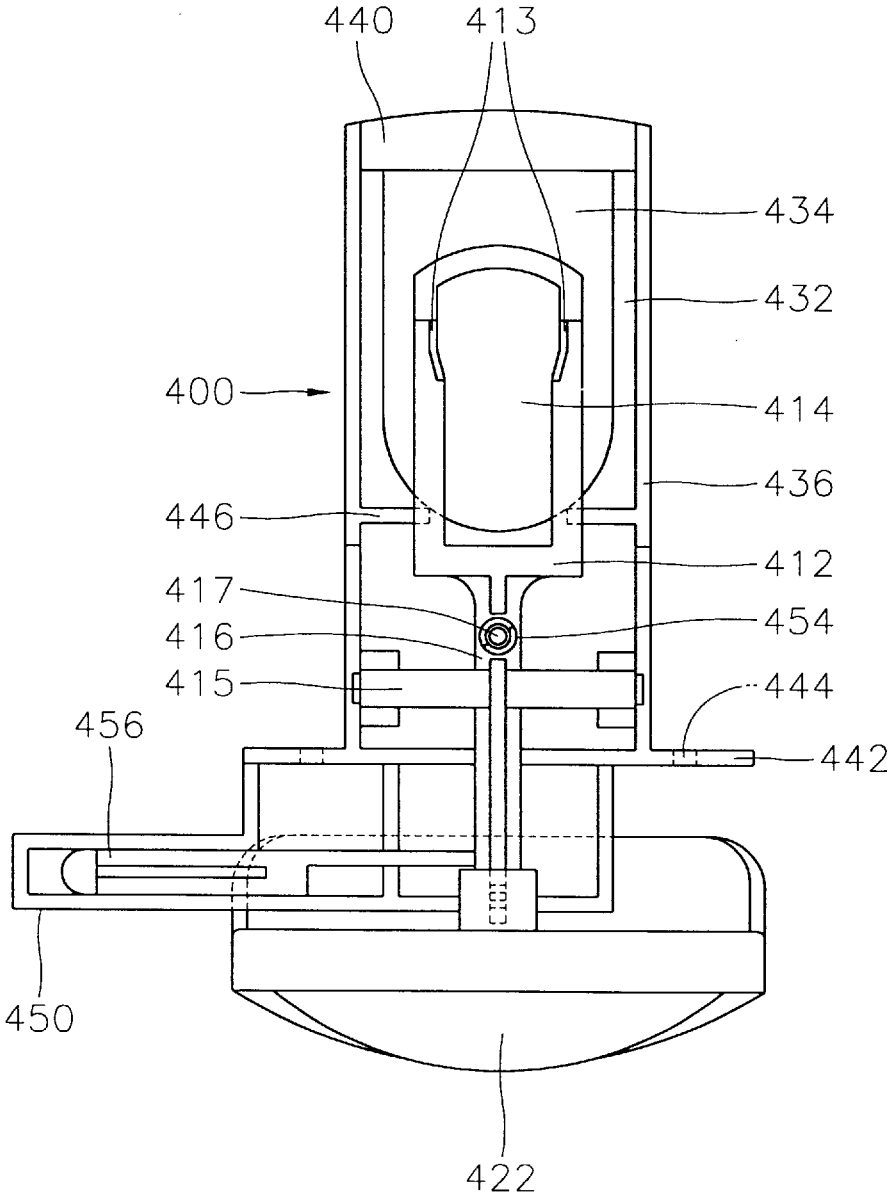
FIG. 6 is a plan view showing the opening part of the water dispenser shown in FIG. 5.

The opening section 400 is mounted to the first mounting plate 392. The opening section 400, as shown FIGS. 5 and 6, includes a lever 410 which opens the valve assembly 320, a button 422 which is engaged with an end of the lever 410 and pivots the lever 410, a subpanel 430, to which the lever 410 is pivotally mounted, a return spring 454 which is installed between the lever 410 and the subpanel 430 and exerts a second biasing force to the lever 410, and a stopper 456 which is slidably mounted in the subpanel 430 and prevents the pivoting of the lever 410.

A dispensing head 412 which opens the valve assembly 320 is connected to other end of the lever 410. The dispensing head 412 is formed with a pair of opening protrusions 413 on an upper surface thereof and is formed with a dispensing hole 414 between the pair of opening protrusions 413. The lever 410 is formed with a hinge 415 on a side surface thereof and with a slit 418, into which the button 422 is inserted. The lever 410 is also formed with a pressing plate 416 on a upper surface thereof, and the pressing plate 416 is formed with a pressing pin 417. The return spring 454 is mounted in surrounding relationship to the pressing pin 417.

The button 422 is formed with a connecting protrusion 424 which 418 is inserted into the slit 418. When the button 422 is pushed down by a user, the lever 410 pivots and overcomes the second biasing force of the return spring 454. At this time, the valve assembly 320 opens the reservoir 306 in such a way that the valve cock 450 is raised by the opening protrusions 413. The water within the reservoir 306 falls down through the valve assembly 320 and the dispensing hole 414.

The lever 410, the stopper 456 and the return spring 454 are installed in the subpanel 430. The subpanel 430 includes a base plate 432 formed with a longitudinal hole 434, a pair of side walls 436 which are formed on both sides of the base plate 432, a mounting guide 440 which connects the side walls 436 to each other and is mounted in surrounding relationship to the bracket 398, a second mounting plate 442, on which the subpanel 430 is mounted to support plate 390, an intermediate plate 446 which is located between the mounting guide 440 and the second mounting plate and protrudes from the inner surfaces of the side walls 436, and a guide rail 450 which is located in front of the second mounting plate 442, and on which the stopper 456 is slidably mounted.

The side wall 436 is formed with a hinge groove 438, into which the hinge 415 is inserted. The lever 410 is pivotally mounted in the subpanel 430 in such a way that the hinge 415 is inserted into the hinge groove 438. The second mounting plate 442 is formed with a pair of mounting holes 444. The subpanel 430 is mounted to the support plate 390 by inserting screws into the mounting holes 444 and the screw holes 395. The intermediate plate 446 has an obstructing jaw 448 which is formed side of the intermediate plate 446 and obstructs the pivoting of the lever 410. When the valve cock 350 is lowered to the first position by the bias spring 372, the pivoting of the lever 410 is obstructed by the obstructing jaw 448.

The stopper 456 has a knob 458 which is formed on lower surface thereof, and the guide rail 450 is formed with a sliding hole 452, into which the knob 458 is inserted. An end of the stopper 456 is formed in a crank-like shape and obstructs the pivoting of the lever 410. The end of stopper 456 is located between the base plate 432 and the button 422 when the stopper 456 is slid. Thus, the lever 410 cannot pivot past the stopper 456 even if the button 422 is being pushed down.

Hereinafter, the operation of the water dispenser 300 of a refrigerator according to an embodiment of the present invention will be explained.

Firstly, the valve assembly 320 is engaged with the reservoir 306 filled with water, and then the mounting member 310 is inserted into the holding member 308. The valve assembly 320 is inserted into the mounting member 310 while the reservoir 306 upside down.

When a user pushes the button 422 down, the lever 410 pivots and overcomes the second biasing force of the return spring 454. Then the pair of opening protrusions 414 of the dispensing head 412 raise the shoulder 356 of the valve cock 350 by overcoming the first biasing force of the bias spring 372. At this time, the packing member 358 opens the outlet conduit 336. Thus, the water in the reservoir 306 falls into a cup via the outlet conduit 336, the dispensing hole 414 and the longitudinal hole 434 (see FIG. 7).

If the button 422 is released, the valve cock 350 is lowered by the first biasing force of the bias spring 372. By the lowering of the valve cock 350, the lever 410 returns to an original position by the second biasing force of the return spring 454. Thus, the packing member 358 is lowered down to the first position and the outlet conduit 336 is closed by the packing member 358.

As described above, the water dispenser of a refrigerator according to the present invention is simple in structure, increases efficient space use of the refrigerating compartment door, is convenient to use, and can be cleanly maintained.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A water dispenser of a refrigerator comprising:

a reservoir installed in a pocket which is adapted to be installed on an inner side of a refrigerator door, for storing water therein;

a holding member for supporting the pocket;

a dispensing panel having a support conduit in which a latching boss is formed on an inner peripheral surface thereof for securing the reservoir, a support plate connected to a lower portion of the support conduit, and a rear plate which has a bracket and supports the support plate, the rear plate being connected to the lower portion of the support plate;

a valve assembly inserted into and mounted to the holding member, the valve assembly having a connecting section connected to the reservoir, a valve cock selectively closing and opening the connecting section at first and second positions respectively, and a bias spring for exerting a first biasing force on the valve cock so that the valve cock is positioned at the first position; and an opening means for opening said valve assembly, said opening means including a subpanel mounted in said dispensing panel, a lever pivotally mounted in a slit in the subpanel, for moving said valve cock so that said valve cock is positioned at the second position, a button provided with a connecting protrusion which is inserted into the slit, for pivoting said lever, and a return spring placed between a lower surface of the support plate and an upper surface of said lever, for exerting a second biasing force to said lever.

2. A water dispenser of a refrigerator according to claim 1, wherein the connecting section further comprises:

a cap screw-coupled to the reservoir;

an outlet conduit formed along the length of the cap and penetrating the centerline of the cap, for exhausting the water contained in the reservoir;

a guide member formed at an inner side of the outlet conduit, the guide member having a first guide hole formed at a center portion thereof, and having a plurality of first exhausting holes formed adjacent to the first guide hole; and a guide conduit formed on the bottom surface of the cap along the length of the cap, the guide conduit being concentric to the outlet conduit and having a diameter larger than that of the outlet conduit, the guide conduit having a mounting groove formed on the outer peripheral surface thereof, wherein the cap, the outlet conduit, the guide member, and the guide conduit are integrally formed.

3. A water dispenser of a refrigerator according to claim 2, further comprising:

a mounting member having a bell-shaped cross section, the mounting member having a first mounting boss formed on the inner peripheral surface thereof and inserted into a mounting recess of the guide conduit, and having a second mounting boss formed on the outer peripheral surface thereof and cooperating with the latching boss of the support conduit.

4. A water dispenser of a refrigerator according to claim 2, wherein the valve cock further comprises:

a first cylinder, in which an inner peripheral surface thereof slides on an outer peripheral surface of the outlet conduit;

a second cylinder, in which an outer peripheral surface thereof slides on an inner peripheral surface of the outlet conduit;

a shoulder connecting one end of the first cylinder to one end of the second cylinder;

a packing member for closing the outlet conduit at the first position and opening the outlet conduit at the second position;

a valve rod slidably inserted into the guide hole, for moving the packing member to the first or second position, the packing member being inserted into and fixed to an upper end of the valve rod; and a fixing rib formed in the interior of the first cylinder, in which a plurality of second exhausting holes are formed, and a lower end of the valve rod being fixed to the fixing rib, wherein the bias spring is installed in a space formed by the outlet conduit, the guide conduit, the first cylinder, and the second cylinder, and the first and second cylinders, the shoulder, and the valve rod are integrally formed.

5. A water dispenser of a refrigerator according to claim 4, wherein the packing member has a conical shape and is comprised of silicon.

6. A water dispenser of a refrigerator according to claim 4, wherein the packing member has a conical shape and is comprised of a rubber.

7. A water dispenser of a refrigerator according to claim 1, wherein said subpanel further comprises:

a base plate, in which a longitudinal hole is formed, a pair of side walls which are connected to both sides of the base plate, and on which hinge grooves are formed;

a mounting guide which connects respective rear ends of the side walls to each other and is mounted in surrounding relationship to the bracket;

a second mounting plate, in which a pair of mounting holes are formed, and on which the subpanel is mounted to the support plate;

an intermediate plate which extends inward from the side wall, and said intermediate plate is provided with a obstruction jaw at a side and is located between said mounting guide and said second mounting plate; and a guide rail located in front of the second mounting plate, in a lower surface thereof a sliding hole is formed.

8. A water dispenser of a refrigerator according to claim 7, wherein said opening means further comprises a stopper for preventing a pivoting of said lever, which is slidably installed in the guide rail.

9. A water dispenser of a refrigerator according to claim 1, wherein said lever includes a dispensing head connected to an end thereof, hinges which is inserted into the hinge grooves and are formed on both sides of said lever, a slit which is formed at other end thereof, and a pressing plate on which a pressing pin is formed, wherein the dispensing head has a pair of opening protrusions which are formed on an upper surface of the dispensing head and move said valve cock so that said valve cock is placed at the second position and said return spring is mounted in surrounding relationship to the pressing pin of said lever.

10. A water dispenser of a refrigerator comprising:

a reservoir installed in a pocket which is adapted to be installed on an inner side of a refrigerator door, for storing water therein;

a holding member for supporting the pocket;

a dispensing panel having a support conduit, in which the latching boss is formed on an inner peripheral surface thereof, a support plate connected to a lower portion of the support conduit, and a rear plate which has a bracket and supports the support plate, the rear plate being connected to the lower portion of the support plate;

a mounting member having a bell-shaped cross-section, the mounting member having a first mounting boss formed on an inner peripheral surface thereof and inserted into a mounting recess of the guide conduit, and having a second mounting boss formed on the outer peripheral surface thereof and cooperating with a latching boss of the support conduit;

a valve assembly inserted into and mounted to the holding member, the valve assembly having a connecting section connected to the reservoir, a valve cock selectively closing and opening the connecting section at first and second positions respectively, and a bias spring for exerting a first biasing force on the valve cock so that the valve cock is positioned at the first position; and an opening section including a base plate, in which a longitudinal hole is formed, a pair of side walls which are connected to both sides of the base plate, and on which hinge grooves are formed, a mounting guide which connects respective rear ends of the side walls to each other and is mounted in surrounding relationship to the bracket, a second mounting plate, in which a pair of mounting holes are formed, and on which the subpanel is mounted to the support plate, an intermediate plate which extends inward from the side wall, and said intermediate plate is provided with a obstruction jaw at a side and is located between said mounting guide and said second mounting plate, and a guide rail located in front of the second mounting plate, in a lower surface thereof a sliding hole is formed; a lever for positioning said valve cock at the second position, said lever having a dispensing head connected to an end thereof, hinges which is inserted into the hinge grooves and are formed on both sides of said lever, a slit which is formed at other end thereof, and a pressing plate on which a pressing pin is formed, wherein the dispensing head has a pair of opening protrusions which are formed on an upper surface of the dispensing head and move said valve cock so that said valve cock is placed at the second position; a return spring mounted in surrounding relationship to the pressing pin for exerting a second biasing force to said lever; and a button for pivoting said lever, the button being provided with a connecting protrusion which is inserted into the slit.

11. A water dispenser of a refrigerator according to claim 10, wherein the connecting section further comprises:

a cap screw-coupled to the reservoir;

an outlet conduit formed along the length of the cap and penetrating the centerline of the cap, for exhausting the water contained in the reservoir;

a guide member formed at an inner side of the outlet conduit, the guide member having a first guide hole formed at a center portion thereof, and having a plurality of first exhausting holes formed adjacent to the first guide hole; and a guide conduit formed on the bottom surface of the cap along the length of the cap, the guide conduit being concentric to the outlet conduit and having a diameter larger than that of the outlet conduit, the guide conduit having a mounting groove formed on the outer peripheral surface thereof, and the cap, the outlet conduit, the guide member, and the guide conduit being integrally formed.

12. A water dispenser of a refrigerator according to claim 11, wherein the valve cock further comprises:

a first cylinder, in which an inner peripheral surface thereof slides on an outer peripheral surface of the outlet conduit;

a second cylinder, in which an outer peripheral surface thereof slides on an inner peripheral surface of the outlet conduit;

a shoulder connecting one end of the first cylinder to one end of the second cylinder;

a packing member for closing the outlet conduit at the first position and opening the outlet conduit at the second position, the packing member having a conical shape;

a valve rod slidably inserted into the guide hole, for moving the packing member to the first or second position, the packing member being inserted into and fixed to an upper end of the valve rod; and a fixing rib formed in the interior of the first cylinder, in which a plurality of second exhausting holes are formed, and a lower end of the valve rod being fixed to the fixing rib.

13. A water dispenser of a refrigerator comprising:

a reservoir installed in a pocket which is adapted to be installed on an inner side of a refrigerator door, for storing water therein;

a holding member for supporting the pocket;

a dispensing panel having a support conduit, in which the latching boss is formed on the inner peripheral surface thereof, a support plate connected to a lower portion of the support conduit, and a rear plate which has a bracket and supports the support plate, the rear plate being connected to the lower portion of the support plate;

a mounting member having a bell-shaped cross-section, the mounting member having a first mounting boss formed on an inner peripheral surface thereof and inserted into a mounting recess of the guide conduit, and having a second mounting boss formed on the outer peripheral surface thereof and cooperating with a latching boss of the support conduit;

a valve assembly comprising a connecting section having a cap screw-coupled to the reservoir, an outlet conduit formed along the length of the cap and penetrating the centerline of the cap, for exhausting the water contained in the reservoir, a guide member formed at an inner side of the outlet conduit, the guide member having a first guide hole formed at a center portion thereof and having a plurality of first exhausting holes formed adjacent to the first guide hole, and a guide conduit formed on the bottom surface of the cap along the length of the cap, the guide conduit being concentric to the outlet conduit and having a diameter larger than that of the outlet conduit, the guide conduit having a mounting groove formed on the outer peripheral surface thereof, and the cap, the outlet conduit, the guide member, and the guide conduit being integrally formed; a valve cock having a first cylinder, in which an inner peripheral surface thereof slides on an outer peripheral surface of the outlet conduit, a second cylinder, in which an outer peripheral surface thereof slides on an inner peripheral surface of the outlet conduit, a shoulder connecting one end of the first cylinder to one end of the second cylinder, a packing member for closing the outlet conduit at the first position and opening the outlet conduit at the second position, the packing member having a conical shape, a valve rod slidably inserted into the guide hole, for moving the packing member to the first or second position, the packing member being inserted into and fixed to an upper end of the valve rod, and a fixing rib formed in the interior of the first cylinder, in which a plurality of second exhausting holes are formed, and a lower end of the valve rod being fixed to the fixing rib; and a bias spring for exerting a first biasing force on the valve cock so that the valve cock is positioned at the first position; and an opening section including a base plate, in which a longitudinal hole is formed, a pair of side walls which are connected to both sides of the base plate, and on which hinge grooves are formed, a mounting guide which connects respective rear ends of the side walls to each other and is mounted in surrounding relationship to the bracket, a second mounting plate, in which a pair of mounting holes are formed, and on which the subpanel is mounted to the support plate, an intermediate plate which extends inward from the side wall, is provided with an obstruction jaw at a side and is located between said mounting guide and said second mounting plate, and a guide rail located in front of the second mounting plate, in which a sliding hole is formed a lower surface thereof; a lever for positioning said valve cock at the second position, said lever having a dispensing head connected to an end thereof, hinges which is inserted into the hinge grooves and are formed on both sides of said lever, a slit which is formed at other end thereof, and a pressing plate on which a pressing pin is formed, wherein the dispensing head has a pair of opening protrusions which are formed on an upper surface of the dispensing head and move said valve cock so that said valve cock is placed at the second position; a return spring mounted in surrounding relationship to the pressing pin, for exerting a second biasing force to said lever; and a button for pivoting said lever, the button being provided with a connecting protrusion which is inserted into the slit.

* * * * *